US005086731A

United States Patent [19]

Lockett et al.

[11] Patent Number: 5,086,731

[45] Date of Patent: Feb. 11, 1992

[54] WATER HEATER

[75] Inventors: John F. Lockett, Cheswick Green; Aik B. Lua, Halesowen, both of England

[73] Assignee: British Gas plc, London, England

[21] Appl. No.: 608,617

[22] Filed: Nov. 5, 1990

Related U.S. Application Data

[63] Continuation of Ser. No. 470,315, Jan. 25, 1990, abandoned.

[30] Foreign Application Priority Data

Mar. 15, 1989 [GB] United Kingdom ..... 8905969

[51] Int. Cl.[5] ..... F22B 1/02; F24H 1/10

[52] U.S. Cl. ..... 122/31.1; 237/8 A; 122/31.2; 126/355; 126/359

[58] Field of Search ..... 122/31.1, 31.2, 20 A; 126/355, 359; 237/8 A

[56] References Cited

U.S. PATENT DOCUMENTS

| | | | |
|---|---|---|---|
| 3,190,283 | 6/1965 | Miyahara | 126/359 |
| 3,386,436 | 6/1968 | Miyahara | 126/355 |
| 3,648,682 | 3/1972 | Bougard | 126/359 |
| 3,826,240 | 7/1974 | Miyahara | 126/355 |
| 3,994,281 | 11/1976 | Godant | 126/359 |
| 4,275,708 | 6/1981 | Wood | 126/355 |
| 4,530,347 | 7/1985 | Baker et al. | 122/31 R |
| 4,574,775 | 3/1986 | Lutzen et al. | 126/355 |
| 4,658,803 | 4/1987 | Ball et al. | 122/31 R |
| 4,686,940 | 8/1987 | Fullemann | 122/31 R |

FOREIGN PATENT DOCUMENTS

| | | |
|---|---|---|
| 402342 | 5/1966 | Switzerland . |
| 825394 | 12/1959 | United Kingdom . |
| 1108492 | 4/1968 | United Kingdom . |
| 1205706 | 9/1970 | United Kingdom . |
| 1495430 | 12/1977 | United Kingdom . |

*Primary Examiner*—Henry C. Yuen
*Attorney, Agent, or Firm*—Larson and Taylor

[57] ABSTRACT

A gas fired direct contact water heater in which the heated water is led off from a reservoir in a lower part of the heater through an outlet conduit including a continuously running pump pumping the heated water along the conduit to a user's valve which is opened when the user requires heated water. To replace that water a water supply conduit controlled by a ball-cock valve conveys water to a first spray bar in an upper part of the heater above heat transfer means through which passes the downward flowing water and upward flowing products of combustion resultant from the burning fuel gas. A return conduit opens into the outlet conduit between the user's valve and the pump. The return conduit leads to a second spray bar in the heater above the heat transfer means. Included in the return conduit is a pressure release valve which opens automatically when subjected to water at a pre-determined slight pressure, when the user's valve is closed, to allow the pump to circulate the water from the reservoir back to the heater for more heating.

13 Claims, 1 Drawing Sheet

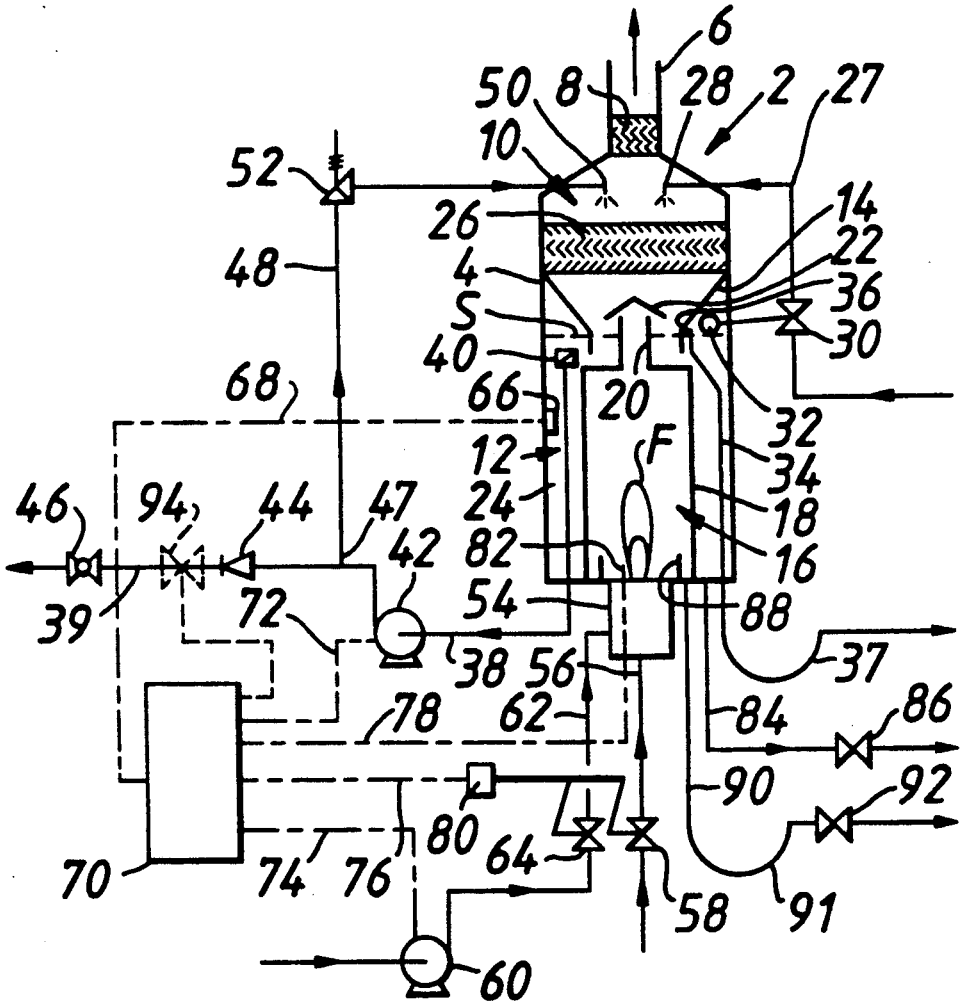
6
50
8
28
2
27
10
52
26
14
22
48
4
36
S
30
40
68
66
20
32
12
F
34
24
18
46
94
44
47
82
16
42
54
88
39
72
38
56
37
78
62
84
86
90
92
80
64
70
74
76
58
91
60

WATER HEATER

This application is a continuation of application Ser. No. 07/470,315 filed Jan. 25, 1990, now abandoned.

BACKGROUND OF THE INVENTION

This invention relates to a gas fired direct contact water heater.

More particularly the invention concerns a gas fired water heater of the type (hereinafter called the type referred to) comprising gas burner means, a flow path for hot products of combustion from said burner means, water supply means to supply water to flow along said flow path in an opposite direction to the simultaneous flow of said products of combustion therealong and wherein heat from said products of combustion becomes transferred to the water which becomes heated thereby, and conduit means to convey said heated water subsequent to it travelling along said flowpath.

One known mode of use of water heaters of the type referred to is to mount the heater in an elevated position to ensure that the heated water output in the conduit means has an adequate head of pressure for the water user's needs when a user controlled valve connected to the conduit means is opened. The need to mount the heater in an elevated position can be a disadvantage because such a position is not always available. Furthermore it can make access to the heater difficult.

In another known mode of use, a pump and a flow detector are included in the conduit means. When the user controlled valve is opened the flow detector observes the slight, low pressure flow of water along the conduit means to meet the demand. In response the flow detector sends a signal to pump control means causing the latter to operate the pump to deliver the water output to the user. When the user's valve is closed, the water flow along the conduit means stops. This is observed by the flow detector which causes the pump control means to stop the pump. One disadvantage of this system is that there is a time delay caused by having to start up the pump and allow it to reach its steady operating state before the water output is at a desired pressure.

In both the aforesaid modes, when there is no demand for water output gas supply to the burner means is automatically turned off. But opening of the user's valve has the effect of causing heater control means to ignite the gas burner means to heat water which is now flowing along the flow path for supply to the user. However, in the interests of safe operation of gas fired apparatus and to meet legal requirements, the control means does not ignite the burner means immediately. Instead the control means causes a stream of purging air to be initially sent through a combustion chamber associated with the burner means for a predetermined period, for example about thirty seconds, before the control means causes the burner means to be ignited. Such a delay in ignition frequently means the occurence of the disadvantage that there is a very noticeable delay before the water being delivered to the user reaches a desired pre-determined elevated temperature.

An object of this invention is the provision of a water heater of the type referred to capable of being constructed to avoid or at least mitigate the aforesaid disadvantages.

SUMMARY OF THE INVENTION

According to the invention a gas fired direct contact water heater comprises gas burner means, wall means defining a flow path for hot products of combustion from said burner means, water supply means for supplying water for flowing along said flow path in an opposite direction to the simultaneous flow of said products of combustion therealong and wherein heat from said products of combustion becomes transferred to the water which becomes heated thereby, first conduit means for conveying said heated water subsequent to travelling along said flow path, said first conduit means having an output portion for a user to take heated water from said first conduit means, pump means included in the first conduit means for pumping heated water therealong to said output portion, second conduit means having first and second opposite ends, said second conduit means being in communication with the first conduit means at said first end intermediate the pump means and the output portion, valve means included in said second conduit means for allowing passage of water through said valve means to the said second end from which the water returns to said flow path, said valve means being pressure release valve means for opening automatically when subjected to water at at least a pre-determined pressure engendered in said second conduit means by the pump means to allow passage of the water through the valve means to said second end for return of the water to said flow path, and the second conduit means having a disposition whereby water is returned from said second conduit means to said flow path independently of said water from said water supply means.

With such a water heater the pump means can be run continuously so that when there is no demand for heated water from the output portion because, for example, a user's valve connected thereto is closed, the heated water from the flow path can be returned via the heated water from the flow path can be returned via the second conduit means and pressure release valve to the flow path for re-heating. When the user's valve is opened, there may now be an immediate supply of heated water for the user's needs.

The pre-determined pressure causing the pressure release valve to open can be low, for example it need not exceed about one bar.

BRIEF DESCRIPTION OF THE DRAWING

The invention will now be further described, by way of example, with reference the accompanying drawing which diagrammatically shows an embodiment of a water heater formed according to the invention.

DETAILED DESCRIPTION OF THE PREFERRED EMBODIMENT

The drawing illustrates a direct contact water heater 2 having a generally cylindrical, upright casing 4 which can be surrounded by insulation (not shown), and is surmounted by a tubular neck 6 forming a flue containing material defining interconnected pores or voids to form a demister pack 8 to restrict the efflux of water vapour or droplets through the flue. Internally the casing 4 is divided into an upper chamber 10 and a lower chamber 12 by a funnel shaped partition 14. The lower chamber 12 contains a cylindrical combustion chamber 16 defined by a wall 18 and surmounted by a tubular outlet neck 20 having its upper open end covered by a cowl 22 which allows substantially free gas flow of gaseous products of combustion from the combustion chamber. An annular reservoir 24 surrounds the combustion chamber 16 and is defined by the casing 4, the wall 18 and neck 20. Heat transfer means 26 extends across the whole of the horizontal cross-section of the chamber 10. The heat transfer means 26 is material, for example metal, defining a plurality of interconnected voids through which fluid can pass in either vertical direction completely through the heat transfer means.

Water from a source, for example the mains, is conveyed by pipe 27 to inlet water distribution means 28 in the chamber 10 above the heat transfer means 26. The distribution means 28 can be in the form of a spray bar comprising a pipe with a plurality of holes in its wall. Pipe 27 includes a control valve or ball-cock 30 having a ball float 32 floating on the surfaces of water in the reservoir 24. Accordingly, when the water level S is at a pre-determined height the ball-cock 30 stops supply of further inlet water to the distribution means 28, but allows supply of inlet water to the chamber 12 should the water level drop below the pre-determined height. To prevent the reservoir 24 over-filling an over-flow pipe 34 ascends through the reservoir 24. The over-flow pipe 34 has an open upper end 36 a short distance above the desired pre-determined water level in the reservoir 24, and a lower part leading to a U-bend or water trap 37 leading to a drain.

An outlet pipe or conduit 38 has an inlet 40 thereto in the reservoir 24 at a height which is a short distance below the desired pre-determined water level. Included in the conduit 38 is an electrically driven water pump 42 and a non-return valve 44 through which water can flow to an output portion 39 of the conduit connected to a user's valve 46 which is opened and closed in accordance with a user's demand for water from the heater 2. One end 47 of another conduit 48 opens into the conduit 40 downstream of the pump 42. The other end of conduit 48 is connected to recirculation water distribution means 50 which can also be in the form of a spray bar and is also in the chamber 10 above the heat transfer means 24. The conduit 48 and distribution means 50 are independent of the distribution means 28 and the conduit 27. Included in the conduit 48 is a pressure release valve 52 arranged to open automatically and allow flow of water from the conduit 40 to the distribution means 50 provided the water pressure in the conduit 48 is at least at a pre-determined value P which may be a relatively low value, for example substantially 0.7 bar (about 10.0 p.s.i.).

The heater 2 has a gas burner 54, for example, nozzle mix burner, which can provide a gas flame F in the combustion chamber 16. The burner 54 is supplied with inflammable gas from a supply (not shown) through a pipe 56 including a control valve 58. Combustion air is supplied under pressure to the burner 54 from an electrically driven pump 60 by way of a pipe 62 which includes a control valve 64.

A temperature sensor 66 in the reservoir 24 sends signals on channel 68 to a control 70, said signals representing the temperature of the water in the reservoir in proximity to the sensor. Control 70 can be an electronic and/or electrical control device which can provide signals on channels 72, 74, 76 and 78 to start or stop the pumps 42 and 60, to control operation of an electric motor 80 which controls operation of the valves 58 and 64, and to control operation of a gas igniter device 82 adjacent to the buner 54.

The reservoir 24 may be drained through a pipe 84 when valve 86 is opened.

At the bottom of the combustion chamber 16 is an annular, drip collecting tray defined between a low annular wall 88 and the surrounding wall 18. This tray may be drained through a pipe 90 comprising a water trap 91 and a normally open valve 92.

Control 70 has two conditions, namely a non-operating condition and an operating condition. When the control 70 is in the operating condition, the heater 2 can either supply heated water at substantially a desired pre-determined temperature or an attempt is being made to heat water in the heater up to that temperature. When the control 70 is in the non-operating condition the control 70 also causes the water pump 42 and the air pump 60 to be stopped. Thus no air is supplied to the combustion chamber 16, neither is any water pumped along conduit 38 towards the user's valve 46 nor along the conduit 48.

In the operating condition the control 70 causes the pumps 42 and 60 to operate continuously each, for example, at a respective substantially constant rate.

Also when the control 70 is in the operating condition it is arranged to respond to water temperature observed by the temperature sensor 66 to the effect that:

(i) when the temperature is below a value $T_1$, which is a pre-determined temperature desired for water to be supplied to the user, the control causes HIGH FIRE combustion in the combustion chamber 16, (ii) when the temperature is greater than $T_1$ but less than a temperature value $T_2$, which is a pre-determined maximum and may be a few degrees Celsuis above $T_1$ (i.e. $T_2 > T_1$), the control causes LOW FIRE combustion in the combustion chamber, and (iii) when the temperature is greater than $T_2$ the control stops the combustion.

For HIGH FIRE the control 70 causes motor 80 to open the valves 58 and 64 to supply the fuel gas and combustion air at respective, maximum, pre-determined HIGH FIRE rates to the burner 54.

For LOW FIRE, control 70 causes the motor 80 to operate the valves 58 and 64 to supply the fuel gas and combustion air at lower, respective, pre-determined LOW FIRE rates. On the temperature reaching $T_2$ at sensor 66, control 70 causes the motor 80 to operate to close the valve 58 to stop the supply of fuel gas whilst at the same time opening the valve 64 to allow air to be blown into the combustion chamber at the HIGH FIRE air supply rate.

In its operating condition the control 70 can also cause operation of the igniter device 82 to ignite the fuel gas from the burner. The control 70 causes operation of the igniter device 82:

(i) when the control is switched from its non-operating to its operating condition, and (ii) when the control is in the operating condition and the water temperature at the sensor 66 drops below $T_2$.

Control 70 is arranged or programmed so that when the igniter device 82 is operated the motor controlled valves 58 and 64 are supplying fuel gas and combustion air at LOW FIRE rates until ignition of the fuel gas is established. Then if the water temperature is less than $T_1$, combustion goes to HIGH FIRE.

Whenever the gas valve 58 is closed the control 70 causes the air supply valve 64 to open to the position corresponding to HIGH FIRE air supply rate. Thus when the control 70 is switched to the operating condition or when the water temperature exceeds $T_2$ there is a purging blast of air through the combustion chamber 16 at HIGH FIRE air supply rate. That purging blast lasts for a desired pre-determined time period $t_b$, for example, about thirty seconds, during which time the control 70 is inhibited from operating the igniter device. The time period $t_b$ is counted out from the instant that control 70 is switched to the operating condition. Period $t_b$ is also counted out from the instant that gas valve 58 is closed when the water temperature reaches $T_2$.

On the control 70 being switched to the operating condition the pump 42 operates, and after the initial air blast purge for time $t_b$ the fuel gas is ignited. If the user's valve 46 is closed, the pumped water has a pressure in excess of the value P and the valve 52 automatically opens allowing the pumped water to re-circulate and issue from the distribution means 50 and flow downwards along a flow path which at least in part passes through the voids in the heat transfer means 26. When the burner 54 is ignited, the hot product of combustion emerge for the flue 20 and pass upwards along the flow path in the opposite direction to water flowing down simultaneously. The water and the hot products of combustion come into direct contact (particularly in the heat transfer means 26) causing the water to be heated. This heated water enters the reservoir 24 where it can be further heated by heat transfer through the wall 18 from the combustion chamber 16. Should the user's valve 46 be opened, this causes a pressure drop in the conduit 48 to below the value P and the valve 52 closes automatically. Because water is leaving the heater system, the water level S drops causing the ball-cock 30 to open allowing mains water to enter the chamber 10 through the distribution means 28 and flow downwads along the flow path through the heat transfer means 26, where it can be heated by the ascending, hot products of combustion provided the burner 54 is lit.

Whilst the control 70 is in the operating condition, any opening of the user's valve 46 allows an instantaneous supply of water by the continuously running pump 42. Should the valve 46 be closed, the water from the reservoir 24 is re-circulated through the conduit 48 and valve 52 to be reheated in the heat transfer means 26 and reservoir 24 to keep the water at substantially the temperature $T_1$ until required by the user.

If desired a valve 94 may be included in the conduit 38 between the user's valve 46 and the conduit 48. Valve 94 can be opened and/or closed in response to signals from the control 70 responding to the observation(s) by the temperature sensor 66 of pre-determined water temperature(s). The control 70 can be arranged so that in the operating condition it will not allow the valve 94 to be open unless the water temperature observed by the sensor 66 is at least a pre-determined value.

Control 70 may be arranged such that when it is first switched to the operating condition from the non-operating condition it will not cause the valve 94 to be opened until the temperature sensor 66 observes the attainment of a pre-determined water temperature $T_3$ which is greater than the aforesaid temperature $T_1$. For exmaple if the temperature $T_1$ at which it is desired to supply heated water is say 38° C. to 40° C. this is a temperature at which the bacteria causing Legionnaires Disease can multiply greatly if the water in the reservoir 24 has been standing for some time before the control is switched to the operating condition. The temperature $T_3$ can be much greater than 40° C., for example substantially 80° C. At that temperature the above mentioned bacteria will be killed before any water can be supplied from the heater 2 to the user. The control 70 can be arranged such that once it has been switched to the operating condition, the valve 94 once opened cannot be closed again until the control is again switched to the non-operating condition.

We claim:

1. A gas fired direct contact water heater comprising gas burner means, wall means defining a flow path for hot products of combustion from said burner means, water supply means for supplying water for flowing along said flow path in an opposite direction to the simultaneous flow of said products of combustion therealong and wherein heat from said products of combustion becomes transferred to the water which becomes heated thereby, first conduit means for conveying said heated water subsequent to travelling along said flow path, said first conduit means having an output portion permitting a user to take heated water from said first conduit means, pump means included in the first conduit means for pumping heated water therealong to said output portion, second conduit means having first and second opposite ends, said second conduit means being in communication with the first conduit means at said first end intermediate the pump means and the output portion, valve means included in said second conduit means for allowing passage of water through said valve means to the said second end of said second conduit means from which the water returns to said flow path, said valve means comprising pressure release valve means for opening automatically when subjected to water at at least a pre-determined pressure engendered in said second conduit means by the pump means to allow passage of the water through the valve means to said second end of said second conduit means for return of the water to said flow path, the water supply means and second conduit means being wholly separate from each other and being arranged such that any water returned from said second conduit means to said flow path is returned independently of said water from said water supply means, said heater further comprising control means, switchable between an operating condition and a non-operating condition, for controlling operation of the pump means and for controlling supply of gas to said burner means such that, in the non-operating condition, said control means causes said supply of gas to be stopped and the pump means to be stopped, and, in the operating condition, said control means causes the pump means to operate continuously.

2. A direct contact water heater according to claim 1, further comprising control means switchable between an operating condition and a non-operating condition, said control means being for controlling operation of the pump means and for controlling supply of gas to said burner means, in the non-operating condition said control means causing said supply of gas to be stopped and the pump means to be stopped, and in the operating condition said control means causing the pump means to operate continuously.

3. A direct contact water heater according to claim 1, wherein said control means in said operating condition controls supply of combustion air and controls said supply of gas to the burner means which includes stopping the said supply of gas, and in said operating condition said control means is arranged for causing air under pressure to be supplied continuously irrespective of whether or not the gas supply is stopped whereby in the event of the gas supply being stopped by said control means in said operating condition air continues to be supplied and flows through a combustion chamber associated with the burner means and along the flow path to flue means beyond said flow path.

4. A direct contact water heater according to claim 2, wherein the first conduit means includes controlled valve means intermediate the output portion and the first end of the second conduit means, temperature observing means for observing the temperature of water from the flow path before that water reaches the output portion, and the control means in said operating condition being for causing the controlled valve means to be opened to allow passage of pumped water to the output portion when the temperature observing means observes that water from the flow path has attained a pre-determined temperature.

5. A direct contact water heater according to claim 1, further comprising temperature observing means for observing the temperature of water from the flow path, and the control means in said operating condition being for varying the gas supply to bring the temperature of the water from the flow path closer to a pre-determined temperature.

6. A direct contact water heater according to claim 1, wherein a reservoir is provided for collecting water from said flow path and for supplying the collected water to the first mentioned conduit means.

7. A direct contact water heater according to claim 1, wherein the flow path is between an upper first position and a lower second position, heat transfer means is disposed between said first and second positions, and said heat transfer means comprises material defining a plurality of voids through which the water being heated and the products of combustion flow in opposite directions simultaneously.

8. A direct contact water heater according to claim 6, wherein said reservoir surrounds a combustion chamber associated with said burner means, and said combustion chamber has a wall permitting flow of heat therethrough to water in said reservoir.

9. A direct contact water heater according to claim 1, wherein said water supply means comprises third conduit means leading to first water distribution means from which water issues directly into said flow path, the second conduit means leads to second water distribution means from which water issues directly into said flow path, and the second conduit means and the second distribution means are disposed for preventing water therefrom from mixing with water from said supply means before the water from the supply means has issued from the first distribution means.

10. A direct contact water heater according to claim 1, wherein said pre-determined pressure has a value not greater than about 1.0 bar.

11. A direct contact water heater according to claim 1, wherein said pre-determined pressure is substantially 0.7 bar.

12. A gas fired direct contact water heater comprising gas burner means, wall means defining a flow path for hot products of combustion from said burner means, water supply means for supplying water for flowing along said flow path in an opposite direction to the simultaneous flow of said products of combustion therealong and wherein heat from said products of combustion becomes transferred to the water which becomes heated thereby, first conduit means for conveying said heated water subsequent to travelling along said flow path, said first conduit means having an output portion permitting a user to take heated water from said first conduit means, pump means included in the first conduit means for pumping heated water therealong to said output portion, second conduit means having first and second opposite ends, said second conduit means being in communication with the first conduit means at said first end intermediate the pump means and the output portion, valve means included in said second conduit means for allowing passage of water through said valve means to the said second end of said second conduit means from which the water returns to said flow path, said valve means comprising pressure release valve means for opening automatically when subjected to water at least a pre-determined pressure engendered in said second conduit means by the pump means to allow passage of the water through the valve means to said second end of said second conduit means for return of the water to said flow path, the second conduit means being arranged such that water is returned from said second conduit means to said flow path independently of said water from said water supply means, said heater further comprising control means, switchable between an operating condition and a non-operating condition, for controlling operation of the pump means and for controlling supply of gas to said burner means such that, in the non-operating condition, said control means causes said supply of gas to be stopped and the pump means to be stopped, and, in the operating condition, said control means causes the pump means to operate continuously.

13. A gas fired direct contact water heater comprising gas burner means, wall means defining a flow path for hot products of combustion from said burner means, water supply means for supplying water for flowing along said flow path in an opposite direction to the simultaneous flow of said products of combustion therealong and wherein heat from said products of combustion becomes transferred to the water which becomes heated thereby, first conduit means for conveying said heated water subsequent to travelling along said flow path, said first conduit means having an output portion permitting a user to take heated water from said first conduit means, pump means, included in the first conduit means, for pumping heated water therealong to said output portion, second conduit means having first and second opposite ends, said second conduit means being in communication with the first conduit means at said first end intermediate the pump means and the output portion, valve means included in said second conduit means for allowing passage of water through said valve means to the said second end of said second conduit means from which the water returns to said flow path, said valve means comprising pressure release valve means for opening automatically when subjected to water at at least a pre-determined pressure engendered in said second conduit means by the pump means to allow passage of the water through the valve means to said second end of said second conduit means for return of the water to said flow path, and the second conduit means being arranged such that water is returned from said second conduit means to said flow path independently of said water from said water supply means, said water supply means comprising third conduit means leading to first water distribution means from which water issues directly into said flow path, the second conduit means leading to second water distribution means from which water issues directly into said flow path, and the second conduit means and the second distribution means being disposed for preventing water therefrom from mixing with water from said water supply means before the water from the water supply means has issued from the first distribution means.

* * * * *